US011579545B2

(12) United States Patent
Ohkubo

(10) Patent No.: US 11,579,545 B2
(45) Date of Patent: Feb. 14, 2023

(54) TONER CONTAINER HAVING SHUTTER AND IMAGE FORMING APPARATUS

(71) Applicant: Yasuhide Ohkubo, Kanagawa (JP)

(72) Inventor: Yasuhide Ohkubo, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/513,930

(22) Filed: Oct. 29, 2021

(65) Prior Publication Data

US 2022/0155707 A1 May 19, 2022

(30) Foreign Application Priority Data

Nov. 17, 2020 (JP) ..... JP2020-191227

(51) Int. Cl.
*G03G 15/08* (2006.01)

(52) U.S. Cl.
CPC ..... *G03G 15/0886* (2013.01); *G03G 15/0868* (2013.01); *G03G 15/0872* (2013.01); *G03G 2215/0692* (2013.01)

(58) Field of Classification Search
CPC ..... G03G 15/0886; G03G 15/0868; G03G 15/0872; G03G 2215/0692; G03G 2215/0668; G03G 2215/0685
USPC ..... 399/262
See application file for complete search history.

(56) References Cited

U.S. PATENT DOCUMENTS 9,128,415 B2 * 9/2015 Takami ..... G03G 15/0879
2008/0298835 A1 * 12/2008 Takashima ..... G03G 15/0898 399/114
2010/0232840 A1 * 9/2010 Kitagawa ..... G03G 15/0865 222/545
2012/0163877 A1 6/2012 Kikuchi et al.
2012/0195645 A1 8/2012 Takami et al.
2012/0219330 A1 8/2012 Kikuchi et al.
2013/0243491 A1 * 9/2013 Nodera ..... G03G 15/0886 399/260
2014/0064794 A1 * 3/2014 Takahashi ..... G03G 15/0886 399/262
2017/0060029 A1 * 3/2017 Yomoda ..... G03G 15/0886
(Continued)

FOREIGN PATENT DOCUMENTS

JP 2011-076064 4/2011
JP 2012-018377 1/2012

*Primary Examiner* — Robert B Beatty
(74) *Attorney, Agent, or Firm* — Xsensus LLP

(57) ABSTRACT

A toner container includes a toner discharge port and a shutter to open and close the toner discharge port. The shutter includes a shutter main portion and shutter deforming portions. Each of the shutter deforming portions includes a stopper and a stopper releaser. The stopper contacts a contact portion of the toner container to restrict a movement of the shutter in an opening direction. The stopper releaser receives an external force from below to displace the stopper upward to release a contact state of the stopper with the contact portion. The stopper releaser of one of the shutter deforming portions releases the contact state with the contact portion independently of another of the shutter deforming portions. When the contact state of the stopper with the contact portion is released in all of the shutter deforming portions, restriction of the movement of the shutter in the opening direction is released.

13 Claims, 9 Drawing Sheets

(56) References Cited

U.S. PATENT DOCUMENTS

| | | | |
|---|---|---|---|
| 2020/0174399 | A1 | 6/2020 | Ohkubo et al. |
| 2020/0183301 | A1 | 6/2020 | Takano et al. |

* cited by examiner

TONER CONTAINER HAVING SHUTTER AND IMAGE FORMING APPARATUS

CROSS-REFERENCE TO RELATED APPLICATION

This patent application is based on and claims priority pursuant to 35 U.S.C. § 119(a) to Japanese Patent Application No. 2020-191227, filed on Nov. 17, 2020, in the Japan Patent Office, the entire disclosure of which is incorporated by reference herein.

BACKGROUND

Technical Field

Embodiments of the present disclosure relate to a toner container disposed in an image forming apparatus such as a copier, a printer, a facsimile machine, or a multifunction peripheral having at least two functions of the copier, the printer, and the facsimile machine.

Related Art

There are known various types of toner containers detachably attached to a main body of an image forming apparatus such as a copier.

SUMMARY

In an embodiment of the present disclosure, there is provided a toner container that includes a toner discharge port and a shutter. The toner discharge port discharges toner contained in the toner container vertically downward in a state in which the toner container is attached in the main body of the image forming apparatus. The shutter opens and closes the toner discharge port. The shutter includes a shutter main portion and a plurality of shutter deforming portions. The shutter main portion engages with a rail extending in the longitudinal direction and moves along the rail to open and closes the toner discharge port. The plurality of shutter deforming portions are integrated with the shutter main portion and deformable upward and downward with respect to a connecting position with the shutter main portion as a base point. Each of the plurality of shutter deforming portions includes a stopper and a stopper releaser. The stopper contacts a contact portion of the toner container to restrict a movement of the shutter in an opening direction in which the shutter opens the toner discharge port from a state in which the toner discharge port is closed by the shutter. The stopper releaser receives an external force from below to displace the stopper upward with elastically upward deformation of each of the plurality of shutter deforming portions to release a contact state of the stopper with the contact portion. The stopper releaser of one of the plurality of shutter deforming portions releases the contact state with the contact portion independently of another of the plurality of shutter deforming portions. When the contact state of the stopper with the contact portion is released in all of the plurality of shutter deforming portions, restriction of the movement of the shutter in the opening direction is released.

In another aspect of the present disclosure, there is provided an image forming apparatus that includes the toner container.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
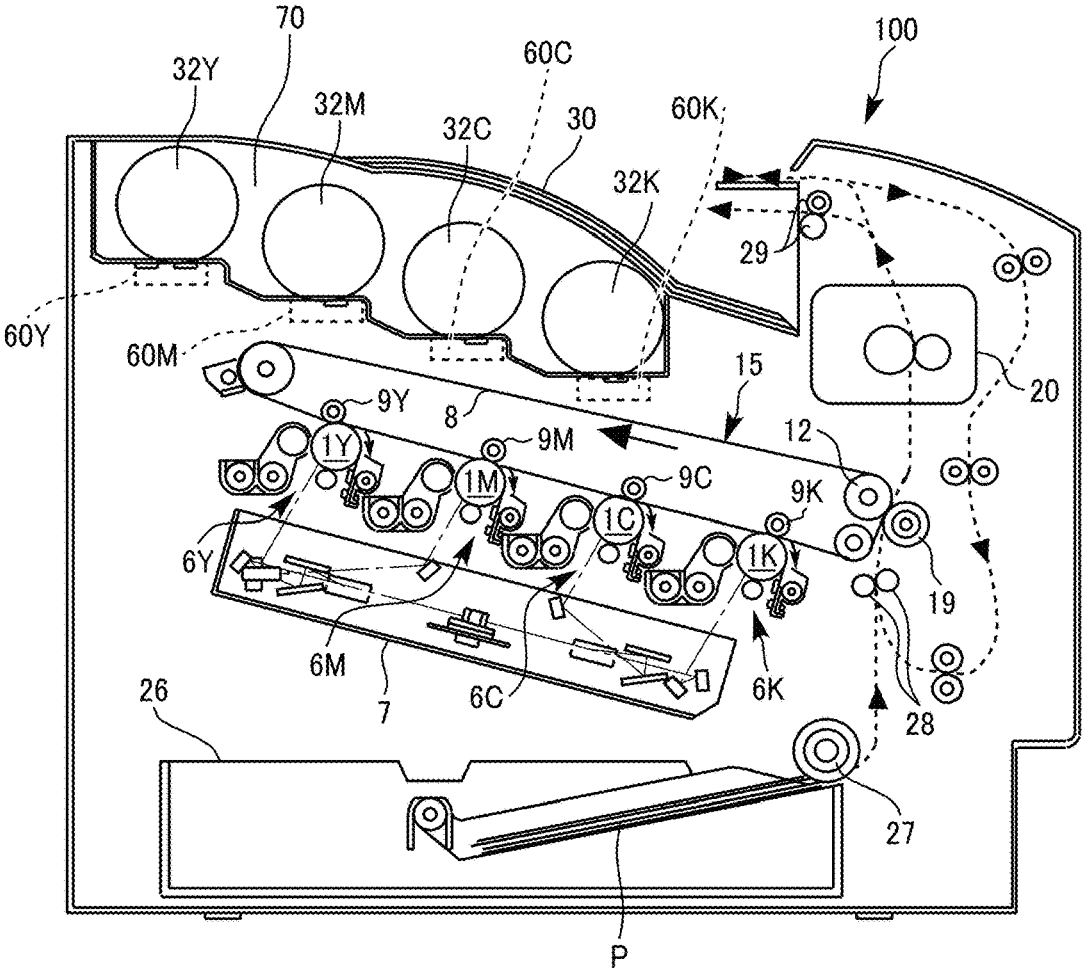
FIG. 1 is a schematic diagram illustrating an overall configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

It is to be noted that, in the following description, suffixes Y, M, C, and K denote colors of yellow, magenta, cyan, and black, respectively. To simplify the description, these suffixes are omitted unless necessary.

Initially with reference to FIG. 1, a description is now given of overall configuration and operation of an image forming apparatus 100. As illustrated in FIG. 1, a toner container mount 70 is disposed in an upper portion of a main body of the image forming apparatus 100. The toner container mount 70 is provided with four removable (or replaceable) toner containers 32Y, 32M, 32C, and 32K for yellow, magenta, cyan, and black, respectively. An intermediate transfer unit 15 is disposed below the toner container mount 70. Image forming units 6Y, 6M, 6C, and 6K are arranged side by side, facing an intermediate transfer belt 8 of the intermediate transfer unit 15, to form toner images of yellow, magenta, cyan, and black, respectively. Below the toner containers 32Y, 32M, 32C, and 32K, toner supply devices 60Y, 60M, 60C, and 60K are disposed, respectively. Toners that are contained in the toner containers 32Y, 32M, 32C, and 32K are supplied by the toner supply devices 60Y, 60M, 60C, and 60K, into developing devices of the image forming units 6Y, 6M, 6C, and 6K, respectively.

Figure 2:
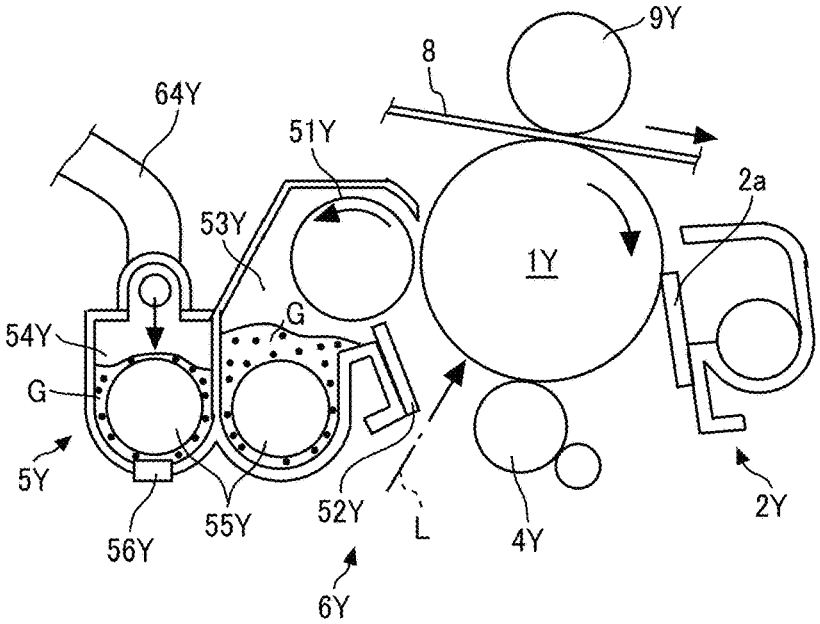
FIG. 2 is a cross-sectional view of an image forming unit of the image forming apparatus illustrated in FIG. 1.

With reference to FIG. 2, the image forming unit 6Y for yellow includes a photoconductor drum 1Y, a charging device 4Y, a developing device 5Y, a cleaning device 2Y, and a charge neutralizer disposed around the photoconductor drum 1Y. A series of image forming processes including charging, exposure, developing, primary transfer, cleaning, and neutralizing processes is performed on the photoconductor drum 1Y. Accordingly, a yellow toner image is formed on the surface of the photoconductor drum 1Y.

The other three image forming units 6M, 6C, and 6K also have substantially the same configuration as the configuration of the image forming unit 6Y for yellow, except that the colors of toner used in the image forming units 6Y, 6M, 6C, and 6K are different from each other. Thus, only the image forming unit 6Y is described below and descriptions of the other three image forming units 6M, 6C, and 6K are appropriately omitted.

Referring to FIG. 2, the photoconductor drum 1Y is rotated clockwise in FIG. 2 by a motor. The charging device 4Y uniformly charges the surface of the photoconductor drum 1Y (in the charging process). When the surface of the photoconductor drum 1Y reaches a position at which the surface of the photoconductor drum 1Y is irradiated with laser beams L emitted from an exposure device 7 (see FIG. 1), the photoconductor drum 1Y is scanned with the laser beams L. Thus, an electrostatic latent image for yellow is formed on the photoconductor drum 1Y (in the exposure process).

When the surface of the photoconductor drum 1Y reaches a position facing the developing device 5Y, the electrostatic latent image is developed with toner into a yellow toner image (in the development process). After the developing process, the surface of the photoconductor drum 1Y bearing the toner image reaches a position facing a primary transfer roller 9Y via the intermediate transfer belt 8, the toner image on the photoconductor drum 1Y is transferred onto the intermediate transfer belt 8 (in a primary transfer process). After the primary transfer process, a slight amount of untransferred toner remains on the photoconductor drum 1Y.

When the surface of the photoconductor drum 1Y reaches a position facing the cleaning device 2Y, a cleaning blade 2*a* of the cleaning device 2Y mechanically collects the untransferred toner on the photoconductor drum 1Y (in the cleaning process). Finally, the surface of the photoconductor drum 1Y reaches a position facing the discharge device which removes residual potentials from the photoconductor drum 1Y. Thus, the series of image forming processes performed on the surface of the photoconductor drum 1Y is completed.

Note that the other image forming units 6M, 6C, and 6K perform the series of image forming processes described above in substantially the same manner as the image forming unit 6Y. That is, the exposure device 7 disposed below the image forming units 6M, 6C, and 6K irradiates photoconductor drums 1M, 1C, and 1K of the image forming units 6M, 6C, and 6K, respectively, with the laser beams L based on image data. Specifically, the exposure device 7 includes a light source to emit the laser beams L, multiple optical elements, and a polygon mirror rotated by a motor. The exposure device 7 scans, with the laser beams L, the photoconductor drums 1M, 1C, and 1K via the multiple optical elements while deflecting the laser beams L with the polygon mirror. Then, toner images formed on the photoconductor drums 1Y, 1M, 1C, and 1K through the development process are transferred and superimposed onto the intermediate transfer belt 8. Thus, a color toner image is formed on the intermediate transfer belt 8.

With reference to FIG. 1, the intermediate transfer unit 15 includes the intermediate transfer belt 8, four primary transfer rollers 9Y, 9M, 9C, and 9K, a secondary transfer backup roller 12, multiple tension rollers, and an intermediate transfer belt cleaner. The intermediate transfer belt 8 is stretched around and supported by the multiple rollers and is rotated in a direction indicated by arrow illustrated in FIG. 1 as the secondary transfer backup roller 12, which is one of the multiple rollers that serves as a drive roller, rotates.

The four primary transfer rollers 9Y, 9M, 9C, and 9K sandwich the intermediate transfer belt 8 together with the four photoconductor drums 1Y, 1M, 1C, and 1K, respectively, thus forming the four primary transfer nips between the intermediate transfer belt 8 and the photoconductor drums 1Y, 1M, 1C, and 1K. A primary transfer bias opposite in polarity to the toner is applied to the primary transfer rollers 9Y, 9M, 9C, and 9K. The intermediate transfer belt 8 is moved in the direction indicated by arrow in FIG. 1 and sequentially passes through the primary transfer nips formed by the primary transfer rollers 9Y, 9M, 9C, and 9K. Thus, the yellow, magenta, cyan, and black toner images are primarily transferred to and superimposed on the intermediate transfer belt 8 from the photoconductor drums 1Y, 1M, 1C, and 1K, respectively, thereby forming a multicolor toner image.

Subsequently, the intermediate transfer belt 8 bearing the multicolor toner image reaches a position facing a secondary transfer roller 19. At the position facing the secondary transfer roller 19, the secondary transfer backup roller 12 sandwiches the intermediate transfer belt 8 with the secondary transfer roller 19 to form a secondary transfer nip between the secondary transfer roller 19 and the intermediate transfer belt 8. The multicolor toner image formed on the intermediate transfer belt 8 is secondarily transferred onto a sheet P (e.g., a sheet of paper) conveyed through the secondary transfer nip in a secondary transfer process. After the secondary transfer process, untransferred toner may remain on the intermediate transfer belt 8 as a residual toner.

Thereafter, the intermediate transfer belt 8 reaches a position facing the intermediate transfer belt cleaner. At the position, the intermediate transfer belt cleaner collects the untransferred toner from the intermediate transfer belt 8. Thus, a series of transfer processes performed on the intermediate transfer belt 8 is completed.

The sheet P is conveyed from a sheet feeder 26 disposed in a lower portion of the main body of the image forming apparatus 100 to the secondary transfer nip via a feed roller 27 and a registration roller pair 28. Specifically, the sheet feeder 26 contains a stack of multiple sheets P such as sheets of paper stacked on one on another. As the feed roller 27 is rotated counterclockwise in FIG. 1, the feed roller 27 feeds a top sheet P from the stack in the sheet feeder 26 to a roller nip between the registration roller pair 28.

The registration roller pair 28 stops rotating temporarily, stopping the sheet P with a leading end of the sheet P nipped in the registration roller pair 28. Subsequently, the registration roller pair 28 is rotated to convey the sheet P to the secondary transfer nip, timed to coincide with the arrival of the multicolor toner image on the intermediate transfer belt 8. Thus, the desired color image is transferred onto the sheet P.

Subsequently, the sheet P, onto which the multicolor image is transferred at the secondary transfer nip, is conveyed to a position of a fixing device 20. Then, at this position, the color image transferred to the surface of the sheet P is fixed on the sheet P by heat and pressure of a fixing roller and a pressure roller. Thereafter, the sheet P bearing the fixed toner image is conveyed through a roller nip formed by an output roller pair 29 and ejected by the output roller pair 29 to an outside of the image forming apparatus 100. The sheets P ejected by the output roller pair 29 are sequentially stacked as output images on a stack tray 30. Thus, a series of image forming processes performed by the image forming apparatus 100 is completed.

Next, a detailed description is provided of a configuration and operations of the developing device 5 of the image forming unit 6 with reference to FIG. 2. The developing device 5Y includes a developing roller 51Y disposed facing the photoconductor drum 1Y, a doctor blade 52Y disposed facing the developing roller 51Y, two conveying screws 55Y disposed in developer containers 53Y and 54Y, and a toner concentration sensor 56Y to detect concentration of toner in a developer. The developing roller 51Y includes a magnet and a sleeve. The magnet is secured inside the developing roller 51Y. The sleeve rotates around the magnet. The developer containers 53Y and 54Y contain a two-component developer G including carrier and toner. The developer container 54Y communicates, via an opening on an upper side thereof, with a toner conveying tube 64Y (serving as a toner conveyance path).

The developing device 5Y described above operates as follows. The sleeve of the developing roller 51Y rotates in a direction indicated by arrow in FIG. 2. The developer G is borne on the developing roller 51Y by a magnetic field generated by the magnet. As the sleeve rotates, the developer G moves along the circumference of the developing roller 51Y.

The developer G in the developing device 5Y is adjusted so that the ratio of toner (i.e., toner concentration) in the developer G is within a predetermined range. More specifically, the toner supply device 60Y (see FIG. 3) supplies toner (as powder) from the toner container 32Y to the developer container 54Y according to the toner consumption in the developing device 5Y. The configuration and operation of the toner supply device 60 are described in detail later.

The toner supplied to the developer container 54Y is mixed and stirred with the developer G by the two conveying screws 55Y while circulating with the developer G in the two developer containers 53Y and 54Y. In this case, the developer G moves in a direction perpendicular to the surface of the paper on which FIG. 2 is illustrated. The toner in the developer G is electrically charged by friction with the carrier and thus is attracted to the carrier. Both the toner and the carrier are borne on the developing roller 51Y due to a magnetic force generated on the developing roller 51Y.

The developer G borne on the developing roller 51Y is conveyed in the direction indicated by arrow in FIG. 2 and reaches a position facing the doctor blade 52Y. At this position, the doctor blade 52Y adjusts the amount of the developer G on the developing roller 51Y to an appropriate amount. Thereafter, the developer G on the developing roller 51Y is conveyed to a position facing the photoconductor drum 1Y (i.e., a developing area). The toner is attracted to the latent image formed on the photoconductor drum 1Y by an electric field generated in the developing area. As the sleeve rotates, the developer G remaining on the developing roller 51Y reaches an upper part of the developer container 53Y and is separated from the developing roller 51Y.

Figure 3:
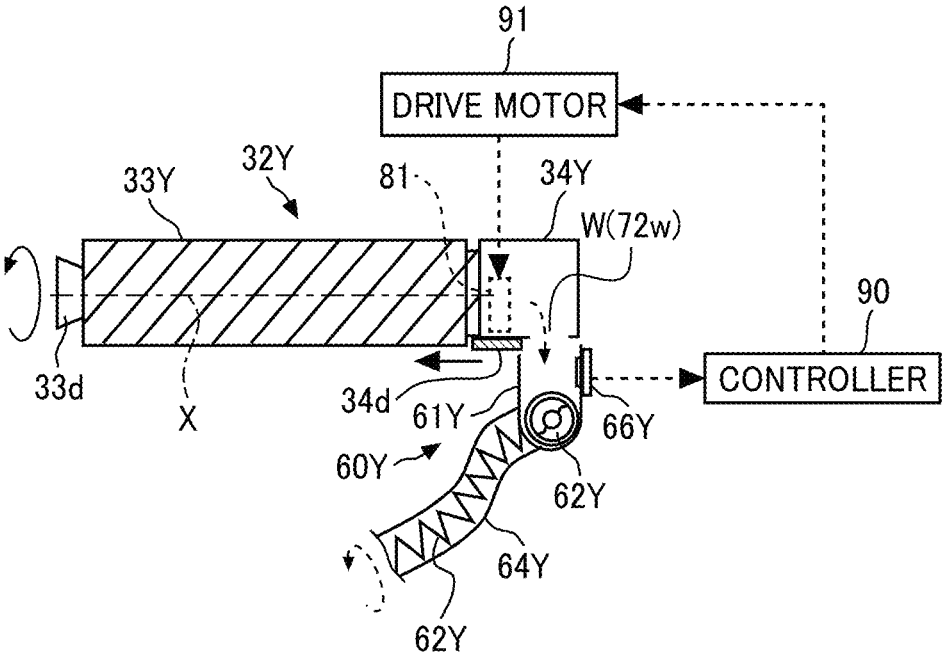
FIG. 3 is a schematic view of a toner container disposed on a toner supply device of the image forming apparatus illustrated in FIG. 1.

Next, with reference to FIGS. 3 and 4, the toner supply devices 60Y, 60M, 60C, and 60K are described in detail below. As illustrated in FIG. 3, the respective color toners in the toner containers 32Y, 32M, 32C, and 32K disposed in the toner container mount 70 in the main body of the image forming apparatus 100 are supplied to the corresponding developing devices by the toner supply devices 60Y, 60M, 60C, and 60K provided for the respective color toners according to the amount of toner consumed in the corresponding developing devices. It is to be noted that the four toner supply devices 60Y, 60M, 60C, and 60K have a similar structure and that the four toner containers 32Y, 32M, 32C, and 32K have a similar structure, except for the color of toner used in the image forming processes. Therefore, only the toner supply device 60Y and the toner container 32Y for yellow are described below as representatives, and descriptions of the toner supply devices 60M, 60C, and 60K and the toner containers 32M, 32C, and 32K for the other three colors are omitted to avoid redundancy.

Figure 4:
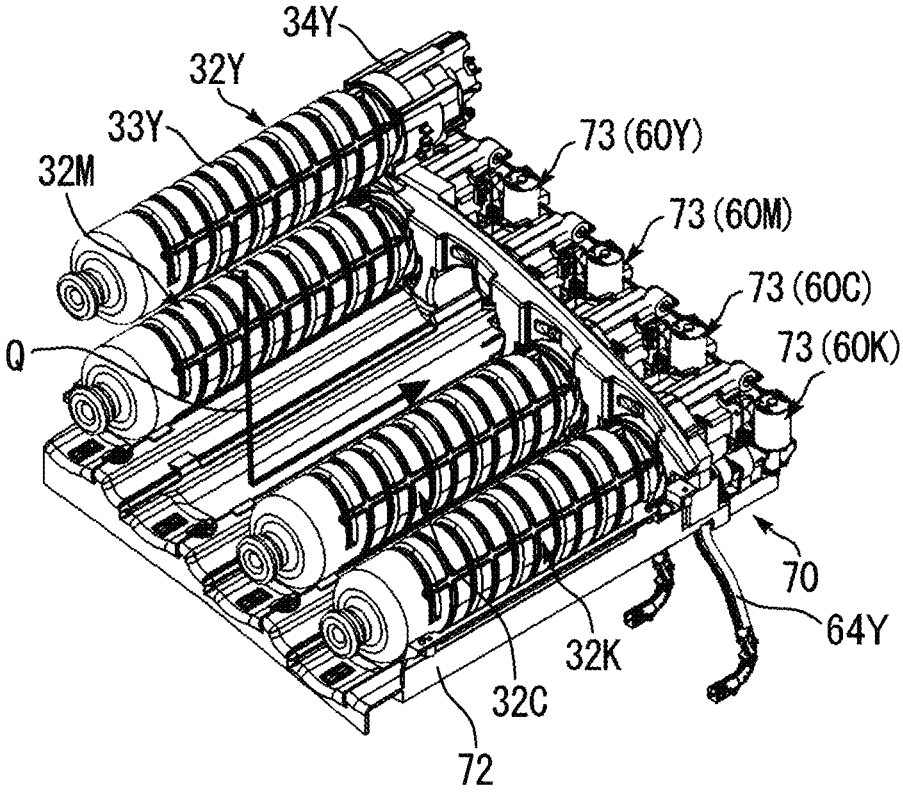
FIG. 4 is a perspective view of the toner container disposed on a toner container mount of the image forming apparatus illustrated in FIG. 1.

As illustrated in FIG. 4, when the toner containers 32Y, 32M, 32C, and 32K are installed to the toner container mount 70 in the main body of the image forming apparatus 100 along the direction indicated by an arrow Q in FIG. 4, shutters 34*d* of the toner containers 32Y, 32M, 32C, and 32K are moved in conjunction with the installation of the toner containers 32Y, 32M, 32C, and 32K to open toner discharge ports W (see FIG. 3) of the toner containers 32Y, 32M, 32C, and 32K. Consequently, the toner discharge ports W of the toner containers 32Y, 32M, 32C, and 32K communicate with toner supply inlets 72*w* (see FIGS. 3, 16A, 16B, and 16C) of the toner container mount 70 specifically, the toner supply devices 60Y, 60M, 60C, and 60K. Accordingly, the toner contained in the toner containers 32Y, 32M, 32C, and 32K is discharged from the toner discharge ports W, passes through the toner supply inlets 72*w* of the toner container mount 70 specifically, the toner supply devices 60Y, 60M, 60C, and 60K), and then, is stored in a toner tank 61Y of the toner supply device 60Y. Referring to FIG. 3, the toner container 32Y is a substantially cylindrical toner bottle and mainly includes a cap 34Y and a container body 33Y (i.e., a bottle body) formed together with a gear 33*c* (see FIG. 6). The cap 34Y is held by the toner container mount 70 so as not to rotate. The container body 33Y is held so as to be rotatable relative to the cap 34Y and is rotated by a driver (including a drive motor 91 and a drive gear 81) in a direction indicated by arrow illustrated in FIG. 3. As the container body 33Y rotates, the toner contained in the toner container 32Y (specifically, the container body 33Y) is conveyed in a longitudinal direction (i.e., a direction from left to right in FIG. 3) of the toner container 32Y by a protrusion 33*b* formed spirally on an inner circumferential face of the container body 33Y. As a result, the toner is discharged from the toner discharge port W of the cap 34Y. That is, the driver rotates the container body 33Y of the toner container 32Y as appropriate, thereby supplying the toner to the toner tank 61Y. Note that the toner containers 32Y, 32M, 32C, and 32K are replaced with new ones when the respective service lives thereof have expired, that is, when almost all toner contained in the toner container 32 has been depleted.

Referring to FIG. 3, the toner supply devices 60Y, 60M, 60C, and 60K include the toner container mount 70, the toner tank 61Y, a toner conveying coil 62Y, a toner end sensor 66Y, the drive gear 81, and the drive motor 91. The toner tank 61Y is disposed below the toner discharge port W of the toner container 32Y to store the toner discharged through the toner discharge port W of the toner container 32Y. A bottom of the toner tank 61Y is coupled to an upstream portion of the toner conveying tube 64Y in a direction in which the toner is conveyed. The toner end sensor 66Y is disposed on a wall face of the toner tank 61Y at a predetermined height from the bottom and detects that the amount of toner stored in the toner tank 61Y has fallen to a predetermined amount or less. A piezoelectric sensor, for example, may be used as the toner end sensor 66Y. When a controller 90 detects "toner end", that is, when the controller 90 detects that the amount of toner stored in the toner tank 61Y is a predetermined amount or less with the toner end sensor 66Y, the controller 90 controls the driver (e.g., the drive motor 91) to rotate the container body 33Y of the toner container 32Y for a predetermined period of time to supply toner to the toner tank 61Y. In a case in which the toner end sensor 66Y continues to detect the "toner end" even when the operations (i.e., detecting operation and toner-supplying operation) are repeated for a number of times, the controller 90 determines that the toner container 32Y is empty and displays a warning message on a control panel of the main body of the image forming apparatus 100 to prompt, e.g., a user to replace the toner container 32Y.

The toner conveying coil 62Y is disposed in the toner conveying tube 64Y so that the toner stored in the toner tank 61Y is conveyed toward the developing device 5Y via the toner conveying tube 64Y. Specifically, the toner conveying coil 62Y conveys the toner from the bottom (i.e., bottom point) of the toner tank 61Y toward an upper side of the developing device 5Y along the toner conveying tube 64Y. Then, the toner conveyed by the toner conveying coil 62Y is supplied into the developing device 5Y (specifically, the developer container 54Y).

Further, referring to FIG. 4, the toner container mount 70 mainly includes a cap holder 73 to hold the cap 34Y of the toner container 32Y and a bottle holder 72 (i.e., a container body holder) to hold the container body 33Y of the toner container 32Y. A configuration and operation of the toner container mount 70 (i.e., the bottle holder 72 and the cap holder 73) are described in detail later with reference to FIG. 15.

With reference to FIG. 1, as a front cover disposed in an upper portion on a front side of the main body of the image forming apparatus 100 is opened, the toner container mount 70 is exposed. Note that the front side refers to a front side in the direction perpendicular to the surface of the paper on which FIG. 1 is illustrated. The toner containers 32Y, 32M, 32C, and 32K are installed in and removed from the front side of the main body of the image forming apparatus 100 with the longitudinal direction of the toner containers 32Y, 32M, 32C, and 32K kept horizontal. On the toner container mount 70, the toner containers 32Y, 32M, 32C, and 32K are moved in the longitudinal direction of the toner containers 32Y, 32M, 32C, and 32K, which may be referred to as an installation direction in the following description. Specifically, when mounted on the main body of the image forming apparatus 100, the toner containers 32Y, 32M, 32C, and 32K are disposed on the toner container mount 70 from above the main body of the image forming apparatus 100 with the front cover open. Then, the toner containers 32Y, 32M, 32C, and 32K are pushed in the horizontal direction with the cap 34Y at the top (i.e., a movement along the arrow Q in FIG. 4). By contrast, when the toner containers 32Y, 32M, 32C, and 32K are separated from the main body of the image forming apparatus 100, an operation reverse to the installation operation is performed.

Figure 5:
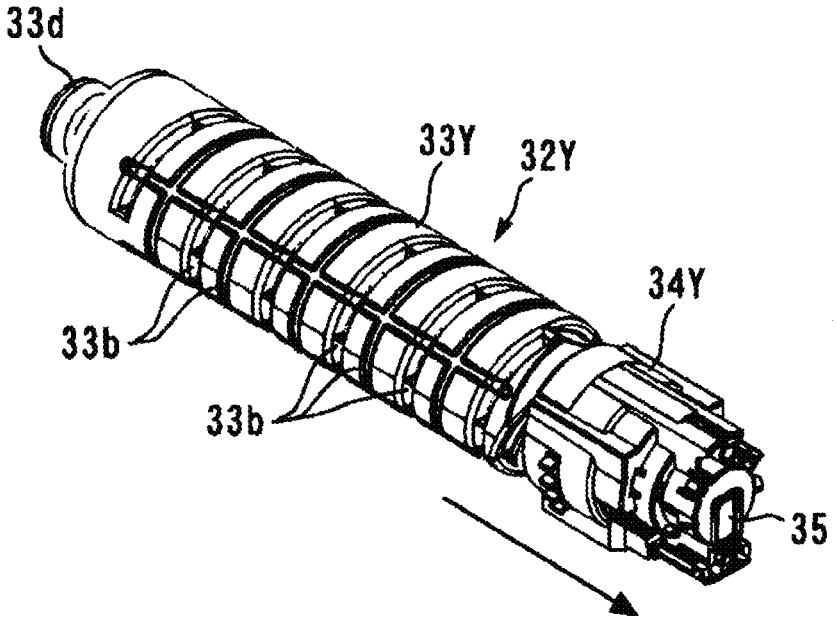
FIG. 5 is a perspective view from above of the toner container illustrated in FIG. 3.
Figure 6:
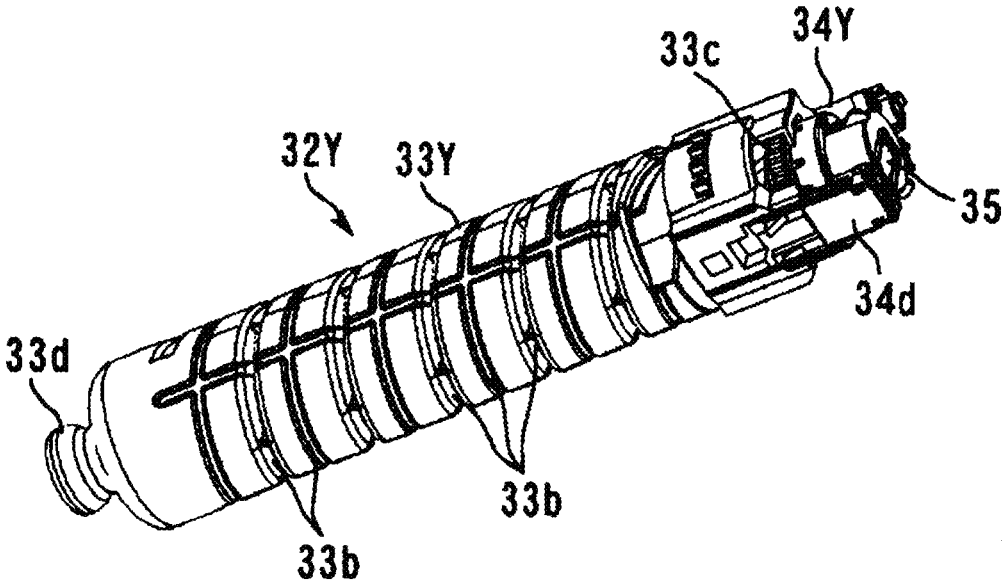
FIG. 6 is a perspective view from below of the toner container illustrated in FIG. 3.

Next, with reference to FIGS. 5 to 14B, the toner containers 32Y, 32M, 32C, and 32K are described in detail. As illustrated in FIGS. 5 and 6, the toner container 32Y mainly includes the container body 33Y and the cap 34Y (i.e., a member communicating with the container body 33Y) disposed on a head of the container body 33Y.

Figure 7:
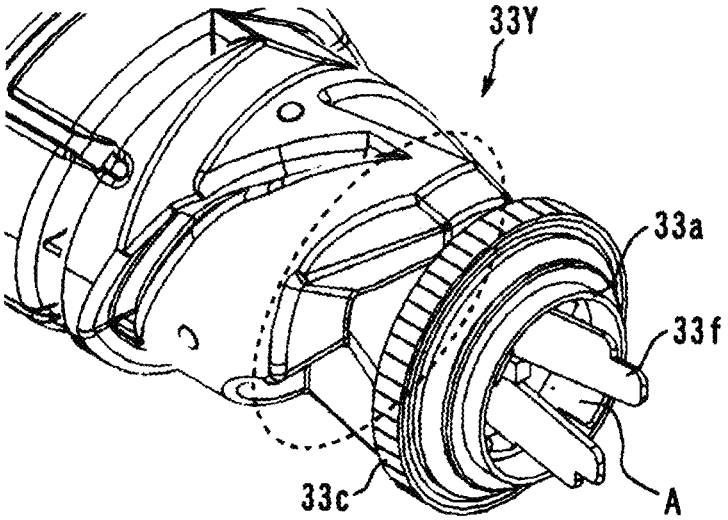
FIG. 7 is a perspective view of a head of a container body of the toner container illustrated in FIG. 3.

The gear 33*c* that rotates integrally with the container body 33Y is disposed with an opening portion A on the head of the container body 33Y, on one end of the container body 33Y in a longitudinal direction of the container body 33Y (i.e., a direction that coincides with an axial direction of the container body 33Y) as illustrated in FIG. 7. The opening portion A is formed on the head of the container body 33Y (i.e., a leading side of the container body 33Y when the toner container 32Y is inserted into the toner container mount 70). The toner contained in the container body 33Y is discharged through the opening portion A to a space (i.e., a cavity B illustrated in FIG. 10) inside the cap 34Y. The container body 33Y is rotated to convey the toner from an inside of the container body 33Y to the cavity B in the cap 34Y appropriately so that the toner in the cap 34Y does not go below a predetermined waterline.

The gear 33*c* meshes with the drive gear 81 provided in the toner container mount 70 of the main body of the image forming apparatus 100 to rotationally drive the container body 33Y around a rotation axis X. Specifically, the gear 33*c* is partly exposed from a notch (see in FIG. 6) formed in the cap 34Y to mesh with the drive gear 81 of the main body of the image forming apparatus 100. As a driving force is transmitted from the drive gear 81 to the gear 33*c*, the container body 33Y rotates.

Referring to FIGS. 5 and 6, a gripper 33*d* that is gripped by a user to attach or detach the toner container 32Y is provided on the other end of the container body 33Y in the longitudinal direction of the container body 33Y (i.e., on a trailing end side of the container body 33Y in the installation direction). The user grips the gripper 33*d* to attach the toner container 32Y to the main body of the image forming apparatus 100 (i.e., a movement in the direction indicated by the arrow illustrated in FIG. 5).

Additionally, the spiral protrusion 33*b* protruding inward is formed on the inner circumferential face of the container body 33Y. In other words, a spiral groove is formed in an outer circumferential face of the container body 33Y when viewed from outside as illustrated in FIG. 5. The spiral protrusion 33*b* discharges toner from the opening portion A when the container body 33Y is rotationally driven in a predetermined direction. The container body 33Y configured in this way can be manufactured by blow molding together with the gear 33*c* and the gripper 33*d* arranged on the circumferential face of the container body 33Y.

Referring to FIG. 7, in the toner container 32Y in the present embodiment, a stirrer 33*f* that rotates together with the container body 33Y is fitted in a bottle slot 33*a* (i.e., the opening A). The stirrer 33*f* is a pair of plate-shaped members extending from the cavity B in the cap 34Y toward the inside of the container body 33Y. The stirrer 33*f* is inclined such that the pair of plate-shaped members is staggered. When the cap 34Y and the container body 33Y are assembled, a tip of the stirrer 33*f* reaches above the toner discharge port W in the cap 34Y while a rear end of the stirrer 33*f* opposite the tip end reaches a scooping section surrounded by a broken circle in FIG. 7 of the head of the container body 33Y. By rotating the stirrer 33*f* together with the opening portion A of the container body 33Y, the toner discharging ability from the opening portion A is enhanced.

The container body 33Y is fitted to the cap 34Y so as to be rotatable relative to the cap 34Y. In other words, the gear 33*c* rotates relative to the cap 34Y. An inner diameter of the head of the container body 33Y (i.e., vicinity of the position where the gear 33*c* is disposed) is smaller than an inner diameter of a toner container section (i.e., the position where the spiral protrusion 33*b* is formed) in which the toner is contained. The head of the container body 33Y includes the scooping section (i.e., the section surrounded by the broken circle in FIG. 7) formed such that the inner circumferential face protrudes inward. The toner that is conveyed toward the opening portion A by the spiral protrusion 33*b* as the container body 33Y rotates is scooped up to the small diameter portion of the head by the scooping section (i.e., the section surrounded by the broken circle in FIG. 7). Thereafter, the toner scooped to the small diameter portion of the head is discharged from the opening portion A toward the cavity B of the cap 34Y while being stirred by the stirrer 33*f*.

Figure 8:
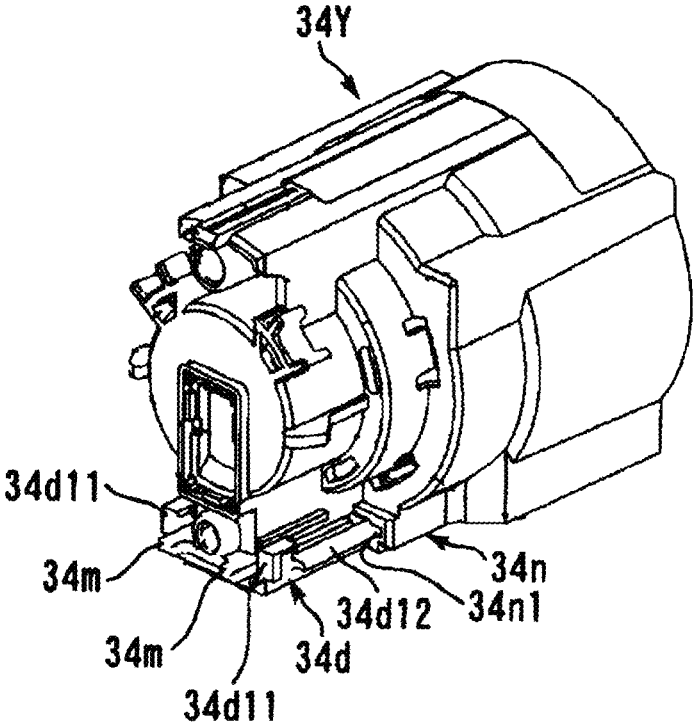
FIG. 8 is a perspective view of a cap of the toner container illustrated in FIG. 3.
Figure 9:
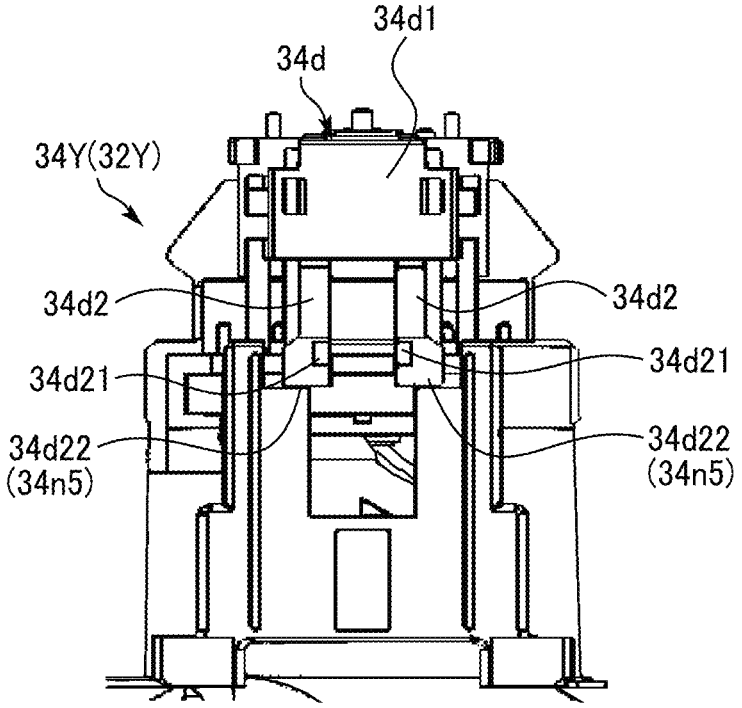
FIG. 9 is a bottom view of the cap of the toner container illustrated in FIG. 8.
Figure 10:
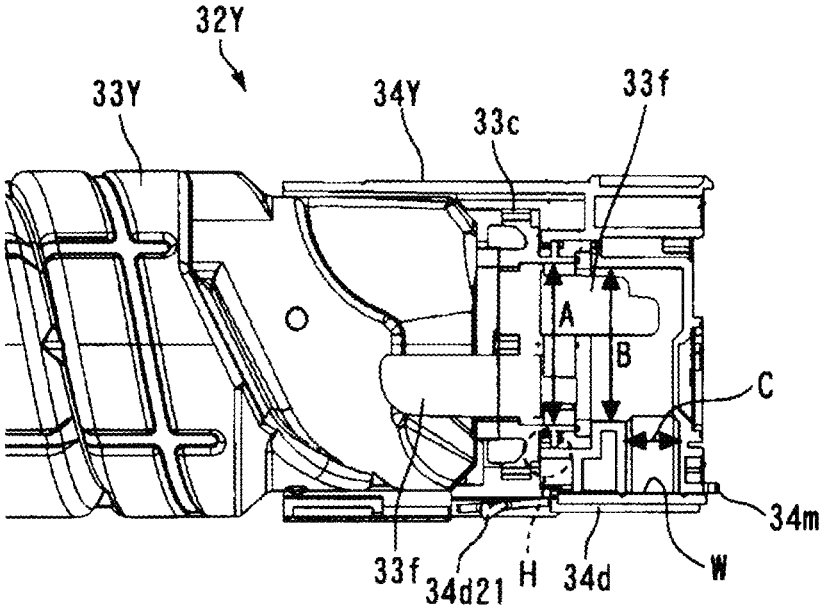
FIG. 10 is a cross-sectional view of a vicinity of the cap of the toner container illustrated in FIG. 3.
Figure 13A:
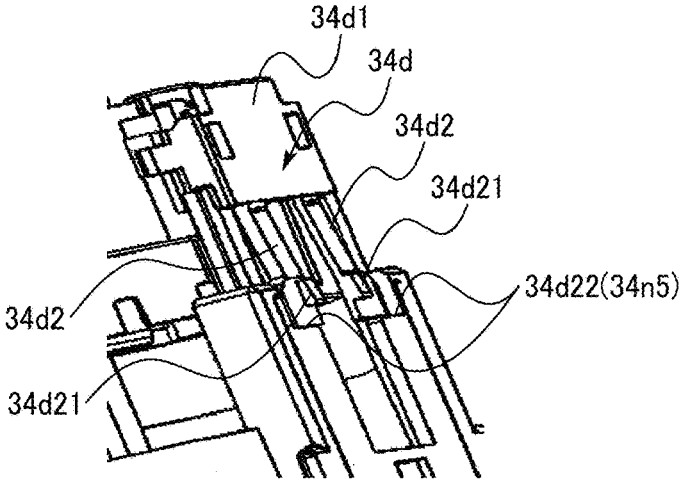
FIG. 13A is a perspective view illustrating a start state of an operation in which the shutter of the toner container opens a toner discharge port.
Figure 13B:
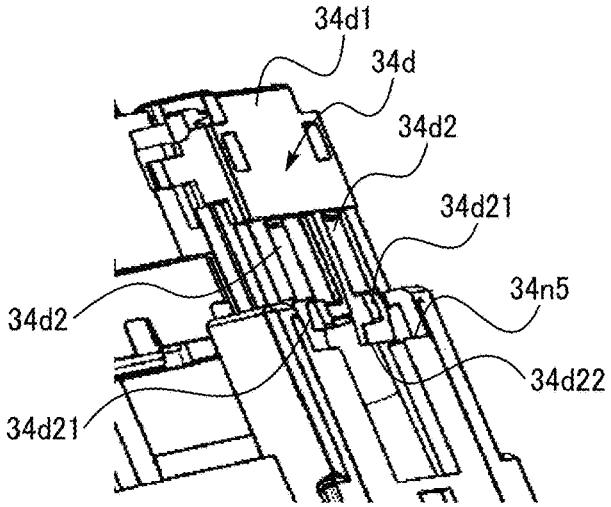
FIG. 13B is a perspective view illustrating a halfway state of the operation in which the shutter of the toner container opens the toner discharge port.
Figure 13C:
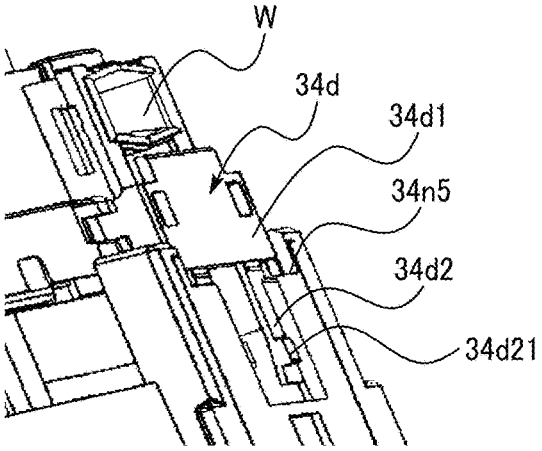
FIG. 13C is a perspective view illustrating an end state of the operation in which the shutter of the toner container opens the toner discharge port.

Referring to FIGS. 8 to 10, the opening portion A of the container body 33Y is inserted into an insertion section of the cap 34Y having an inner diameter larger than the inner diameter of the cavity B. Referring to FIGS. 10 and 13C, the cap 34Y attached to the main body of the image forming apparatus 100 has the toner discharge port W to discharge the toner (i.e., the toner discharged from the opening portion A of the container body 33Y) contained in the toner container 32Y. The toner drops (by own weight) through the toner discharge port W outside the toner container 32Y and downward in the vertical direction. The shutter 34*d* that opens and closes the toner discharge port W is held in the cap 34Y so as to be slidable.

Figure 14A:
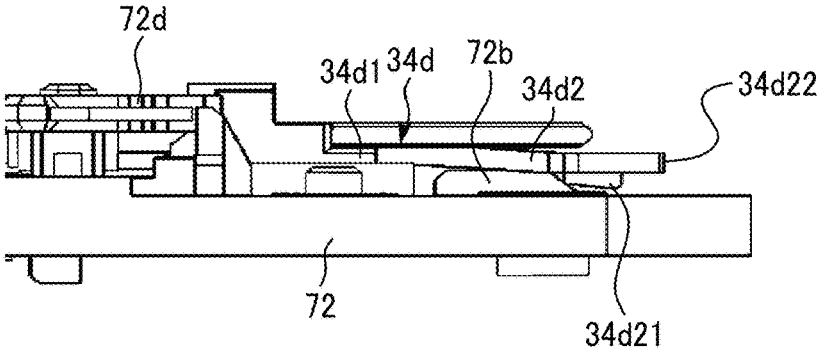
FIG. 14A is a side view illustrating a state before a stopper releaser of the shutter is pushed up by a stopper release biasing portion with an installation of the toner container.
Figure 14B:
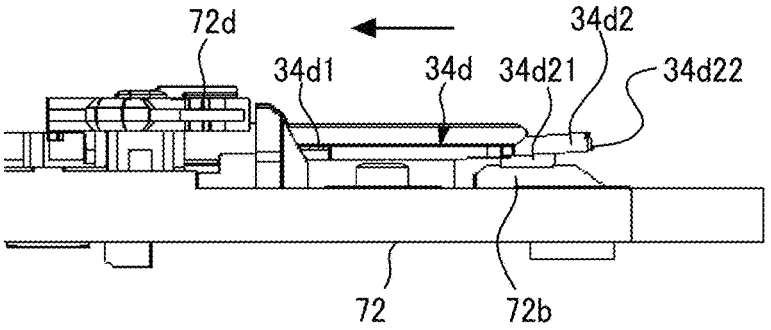
FIG. 14B is a side view illustrating a state after the stopper releaser of the shutter is pushed up by the stopper release biasing portion with the installation of the toner container.

Specifically, the shutter 34*d* opens the toner discharge port W by a relative movement (i.e., a movement downward in FIG. 9) along the length of the toner container 32Y from the cap 34Y to the container body 33Y. The shutter 34*d* closes the toner discharge port W by a relative movement (i.e., a movement upward in FIG. 9) along the length of the toner container 32Y from the container body 33Y to the cap 34Y. The opening and closing operations of the shutter 34*d* (i.e., the opening and closing operations of the toner discharge port W) is performed in conjunction with the attaching and detaching operations of the toner container 32Y to and from the toner container mount 70 (i.e., the main body of the image forming apparatus 100) in the longitudinal direction. FIGS. 13A to 13C are schematic diagrams illustrating an operation from the start of opening of the toner discharge port W to the completion of opening of the toner discharge port W by the shutter 34*d*. FIGS. 14A and 14B are schematic diagrams illustrating a movement of the shutter 34*d* (i.e., a shutter deforming portion 34*d*2) in the opening operation of the toner discharge port W.

Referring to FIG. 8, the cap 34Y has a shutter storage 34*n* in a bottom of the cap 34Y. When the shutter 34*d* opens the toner discharge port W, a part of the shutter 34*d* (i.e., the shutter deforming portion 34*d*2) is stored in the shutter storage 34*n*. The shutter storage 34*n* internally holds and stores the shutter deforming portion 34*d*2 (i.e., see FIGS. 11 and 12) after the shutter 34*d* opens the toner discharge port W. Referring to FIG. 8, a slide groove 34*n*1 that functions as a rail that guides the opening and closing operations of the shutter 34*d* is formed on an inner face of the shutter storage 34*n*. The slide groove 34*n*1 as the rail is a groove portion extending parallel to the longitudinal direction of the cap 34Y, and extends from a front side (i.e., the right side in FIG. 10) of the shutter storage 34*n*.

The cap 34Y configured as described above communicates with the container body 33Y through the opening portion A to discharge the toner discharged from the opening portion A through the toner discharge port W (i.e., a movement in the direction indicated by broken rotating arrow illustrated in FIG. 3). In the present embodiment, with reference to FIG. 10, the substantially columnar cavity B (i.e., a space) extends inside the cap 34Y in the longitudinal direction (i.e., the lateral direction in FIG. 10). In addition, a cylindrical toner dropping passage C having a fixed flow area (i.e., cross-sectional area) extends from a lower circumferential face of the substantially columnar cavity B toward the toner discharge port W in the cap 34Y. With this configuration, the toner discharged from the opening portion A of the container body 33Y to the cavity B in the cap 34Y drops through the toner discharge port W smoothly outside the toner container 32Y (i.e., the toner tank 61Y) by its own weight.

Figure 11:
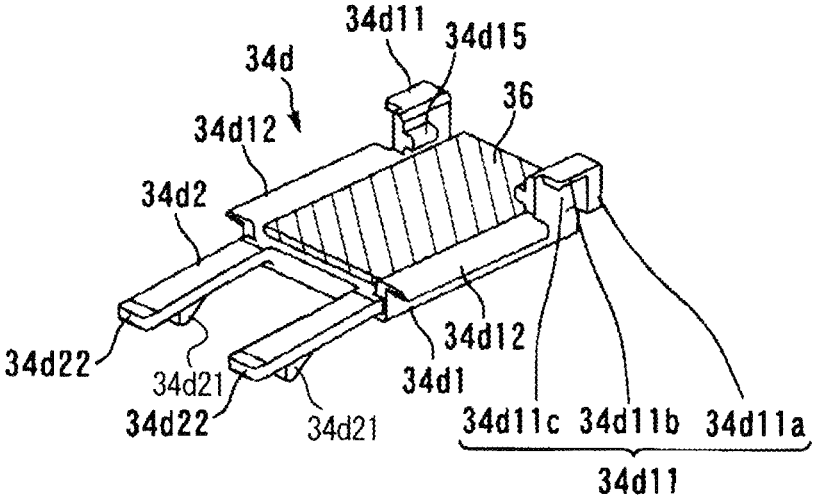
FIG. 11 is a perspective view of a shutter of the toner container illustrated in FIG. 3.
Figure 12:
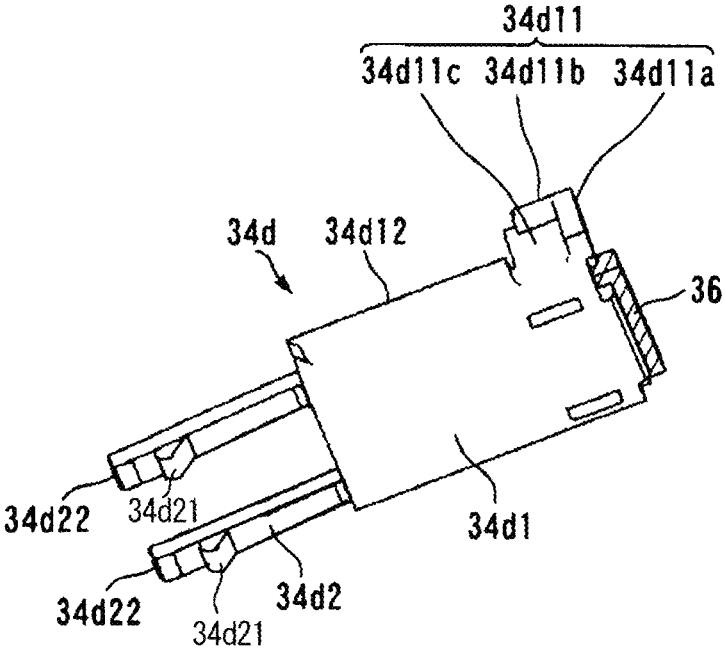
FIG. 12 is another perspective view of the shutter illustrated in FIG. 11.

The cap 34Y configured as described above includes the shutter 34*d* in the bottom of the cap 34Y. The shutter 34*d* has a shutter seal 36 attached on a surface facing the toner discharge port W. As illustrated in FIGS. 13A to 13C, the shutter 34*d* opens and closes the toner discharge port W in conjunction with the attaching and detaching operations of the toner container 32Y to and from the toner container mount 70. For details, with reference to FIGS. 11 and 12, the shutter 34*d* has a plate-shaped shutter main portion 34*d*1 and the two shutter deforming portions 34*d*2. The two shutter deforming portions 34*d*2 that protrude from the shutter main portion 34*d*1 toward the container body 33Y attached to the cap 34Y are thinner than the shutter main portion 34*d*1 and have elasticity. The shutter main portion 34*d*1 includes a pair of shutter sliders 34*d*12 on both outer sides and a pair of shutter rail engaging portions 34*d*15 on both inner sides thereof. The shutter slider 34*d*12 is a pair of protrusions that extend parallel to the installation direction of the toner container 32Y on the side portions of the shutter main portion 34*d*1. The shutter rail engaging portions 34*d*15 is a pair of protrusions that protrude inside the shutter main portion 34*d*1 (in a direction opposite the direction in which the shutter slider 34*d*12 protrudes) at a predetermined distance from the shutter seal 36. The shutter slider 34*d*12 of the shutter main portion 34*d*1 is engaged with the slide groove 34*n*1 (i.e., a first rail) of the cap 34Y. A shutter rail (i.e., a second rail) of the cap 34Y is engaged so as to be sandwiched between the shutter rail engaging portion 34*d*15 and the shutter seal 36 of the shutter main portion 34*d*1. Thus, the shutter 34*d* moves along the slide grooves 34*n*1 (i.e., the rails) so that the shutter main portion 34*d*1 opens the toner discharge port W. The shutter seal 36 as a seal member is attached to an upper face of the shutter main portion 34*d*1 (i.e., the face facing the toner discharge port W). The shutter seal 36 prevents the toner from leaking from between the shutter main portion 34*d*1 and the toner discharge port W when the shutter main portion 34*d*1 (i.e., the shutter 34*d*) closes the toner discharge port W. The shutter seal 36 may be made of a foam resin material, for example. As illustrated in FIGS. 11 and 12, the shutter seal 36 in the present embodiment is disposed so as to protrude from an end portion of the shutter 34*d* in the longitudinal direction (i.e., in the installation direction). A tip portion (i.e., a protruding portion) of the shutter seal 36 contacts a wall portion formed around the toner supply inlet 72*w* (see FIGS. 15 to 16C) when the cap 34Y is attached to the cap holder 73, thus functioning as a sealing material to prevent the toner in the toner container 32Y from leaking to the vicinity of the toner supply inlet 72*w*.

Referring to FIGS. 11 and 12, the two shutter deforming portions 34*d*2 of the shutter 34*d* are integrally formed with the shutter main portion 34*d*1, and are formed so as to be elastically deformed upward and downward from a connecting position at which the shutter deforming portions 34*d*2 are in connection with the shutter main portion 34*d*1. The two shutter deforming portions 34*d*2 are disposed closer to the container body 33Y than the shutter main portion 34*d*1 is in a longitudinal direction of the shutter 34*d*. Each of the two shutter deforming portions 34*d*2 has a stopper 34*d*22 and a stopper releaser 34*d*21. Each of the two shutter deforming portions 34*d*2 extends from the shutter main portion so as to have a downward slope in FIG. 10. The two stoppers 34*d*22 of the shutter deforming portions 34*d*2 are wall portions formed at an end of the shutter deforming portions 34*d*2 (i.e., the tip of the shutter deforming portion 34*d*2 away from the shutter main portion 34*d*1) in an opening direction (i.e., in the left direction in FIGS. 14A and 14B). The stopper 34*d*22 abuts on a contact portion 34*n*5 (see FIGS. 9, 13A, 13B, and 13C) formed in the shutter storage 34*n* of the cap 34Y, to restrict a movement of the shutter 34*d* closing the toner discharge port W in the opening direction in which the shutter 34*d* opens the toner discharge port W. That is, when the toner container 32Y is in a single state in which the toner container 32Y is not set in the main body of the image forming apparatus 100, the two stoppers 34*d*22 of the shutter 34*d* are in contact with the contact portion 34*n*5, thus preventing the shutter 34*d* from independently moving in the opening direction and opening the toner discharge port W.

As illustrated in FIGS. 13A to 13C, the stopper releaser 34*d*21 (i.e., the stopper release protrusion) protrudes downward from the shutter deforming portion 34*d*2. As the shutter deforming portion 34*d*2 receives an external force from below and elastically deforms, the stoppers 34*d*22 move upward and are disengaged from the contact portion 34*n*5. The stopper releaser 34*d*21 is formed between the stopper 34*d*22 and the connecting position between the shutter main portion 34*d*1 and the shutter deforming portion 34*d*2. The stopper releaser 34*d*21 is a mountain-shaped protrusion that slopes on both sides in the longitudinal direction. The stopper releaser 34*d*21 contacts a stopper release biasing portion 72*b* (see FIG. 15) formed in the bottle holder 72 in conjunction with the mounting operation of the toner container 32Y on the toner container mount 70. Then, the stopper releaser 34*d*21 is pushed upward by the stopper release biasing portion 72*b*. In other words, the stopper releaser 34*d*21 receives an external force from below. Accordingly, the shutter deforming portion 34*d*2 is elastically deformed upward and the stopper 34*d*22 is also displaced upward. In this way, the stopper 34*d*22 is separated from the contact portion 34*n*5, allowing the movement of the shutter 34*d* in the opening direction. In the present embodiment, since the shutter deforming portion 34*d*2 is inclined downward as described above, the slope is offset by being pushed upward by the stopper release biasing portion 72*b* and elastically deformed. Thus, the slope is linear with respect to the shutter main portion 34*d*1. A warping amount of the shutter deforming portion 34*d*2 upward with respect to the shutter main portion 34*d*1 in the shutter storage 34*n* is relatively small (or the warping amount is zero). Therefore, defects are restrained that the shutter deforming portion 34*d*2 housed in the shutter storage 34*n* contacts the container body 33Y, and the space of the shutter storage 34*n* is effectively utilized. Features of the shutter 34*d* are further described in detail later.

Referring to FIGS. 13A, 13B, 13C, 14A, and 14B, the operation of the shutter 34*d* in conjunction with the operation of attaching the toner container 32Y to the toner container mount 70 is described in detail. It is to be noted that the positions of the shutter 34*d* illustrated in FIGS. 13B and 13C respectively correspond to the positions of the shutter 34*d* illustrated in FIGS. 14A and 14B. As illustrated in FIG. 13A, when the installation of the toner container 32Y into the toner container mount 70 is started and the stopper releaser 34*d*21 (serving as the two stopper releasers) of the shutter 34*d* has not yet reached the position of the stopper release biasing portion 72*b* (see FIGS. 14A, 14B, and 15) formed in the bottle holder 72, the two stoppers 34*d*22 of the shutter 34*d* are in contact with the contact portions 34*n*5, and thus the movement of the shutter 34*d* in the opening direction is restricted. After that, when the installation of the toner container 32Y proceeds, as illustrated in FIGS. 13B and 14A, the stopper releaser 34*d*21 of the shutter 34*d* reaches the position of the stopper release biasing portion 72*b*. When the installation of the toner container 32Y further proceeds, as illustrated in FIGS. 13C and 14B, the two stopper releasers 34*d*21 are pressed up by the two stopper release biasing portions 72*b*. Each of the two shutter deforming portions 34*d*2 elastically deforms at the connecting position as the base point between the shutter deforming portion 34*d*2 and the shutter main portion 34*d*1. Accordingly, the contact state between the stopper 34*d*22 and the contact portion 34*n*5 is released, and the shutter 34*d* relatively moves in the opening direction. After that, the shutter 34*d* contacts the wall portion (see FIGS. 15, 16A, 16B, and 16C) formed around the toner supply inlet 72*w* of the cap holder 73. The movement of the shutter 34*d* in the toner container mount 70 (i.e., the cap holder 73) is restricted. Thus, the shutter 34*d* is prevented from moving in the longitudinal direction. Since the movement of the toner container 32Y progresses in the installation direction, the shutter 34*d* moves relatively in the opening direction. That is, as illustrated in FIG. 13C, the shutter 34*d* moves relatively toward the container body 33Y, and then, the shutter deforming portions 34*d*2 are stored in the shutter storage 34*n*. In this way, the opening of the toner discharge port W by the movement of the shutter 34*d* in the opening direction is finished.

Figure 15:
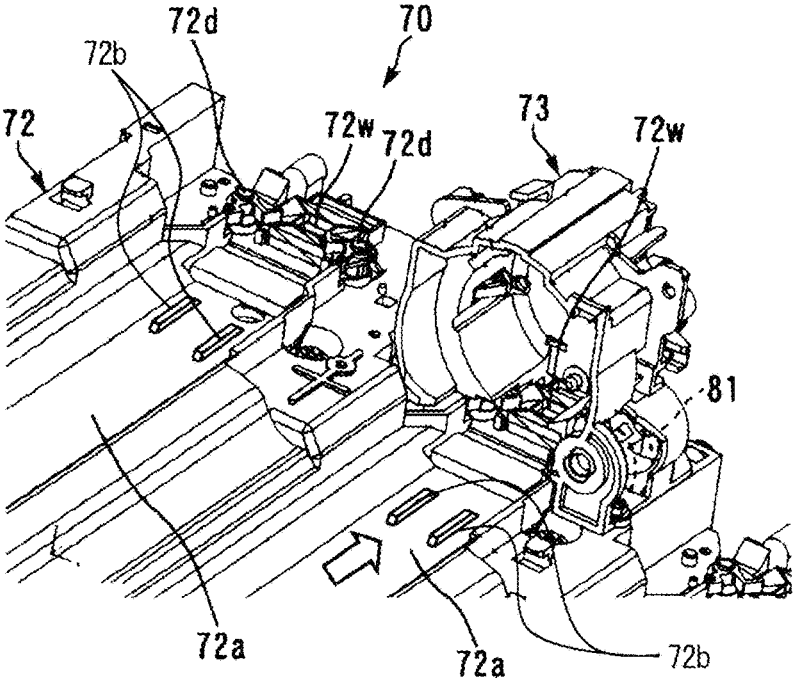
FIG. 15 is a perspective view of a vicinity of a bottle holder in the toner container mount illustrated in FIG. 4.
Figure 16A:
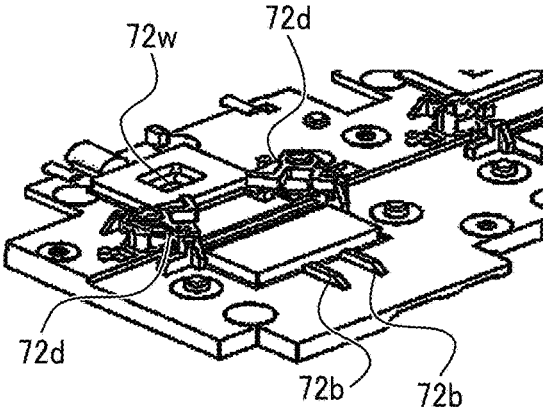
FIG. 16A is a perspective view illustrating a start state of an operation of the shutter with an installation of the toner container in the toner container mount.
Figure 16B:
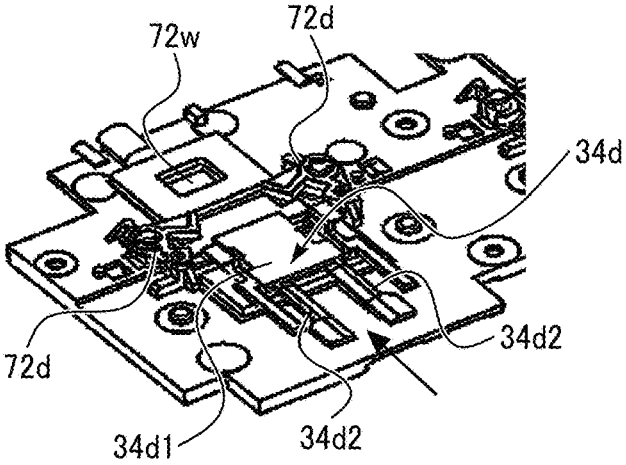
FIG. 16B is a perspective view illustrating a halfway state of the operation of the shutter with the installation of the toner container in the toner container mount.
Figure 16C:
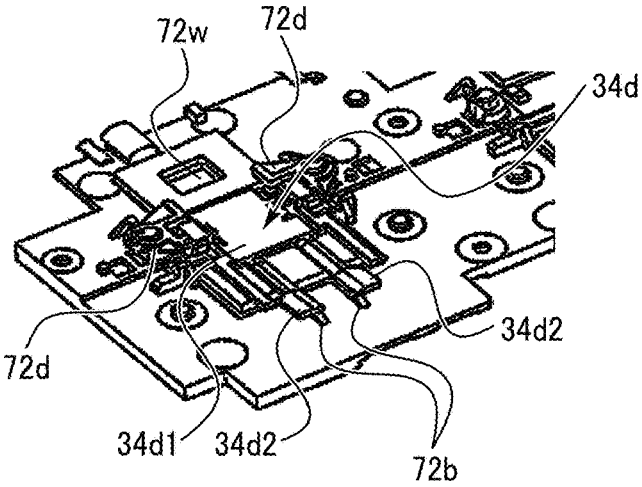
FIG. 16C is a perspective view illustrating an end state of the operation of the shutter with the installation of the toner container in the toner container mount.

Next, with reference to FIGS. 15, 16A, 16B, and 16C, the toner container mount 70 of the main body of the image forming apparatus 100 is described in detail. As described above with reference to FIG. 4, the toner container mount 70 has the bottle holder 72 and the cap holder 73. The toner container 32Y is installed on a bottle receiving face 72*a* of the bottle holder 72 from above by a user in a state in which the longitudinal direction of the toner container 32Y is horizontal. The cap 34Y is located at the head of the container body 33Y. The bottle is pushed toward the cap holder 73 while sliding on the bottle receiving face 72*a* with the longitudinal direction as the installation direction. Referring to FIG. 15, the bottle holder 72 has the bottle receiving face 72*a* for each color. The cap holder 73 is formed at each end of the bottle receiving face 72*a*. The corresponding toner containers 32Y, 32M, 32C, and 32K are inserted into the cap holder 73 (e.g., inserted in the direction indicated by the white arrow in FIG. 15). The respective caps 34Y are held in the bottle holder 72 without rotation. In FIG. 15, in order to illustrate the configuration of the bottle holder 72, an illustration of a part of the four cap holders 73 is omitted. In FIGS. 16A to 16C, in order to illustrate the operation of the shutter 34*d* when the toner container 32Y is attached to the toner container mount 70, illustrations other than the main parts of the toner container mount 70 and the toner container 32Y are omitted.

Referring to FIGS. 15, 16A, 16B, and 16C, the bottle holder 72 of the toner container mount 70 has the bottle receiving face 72*a*, the stopper release biasing portion 72*b* (i.e., two stopper release biasing portions 72*b* for each bottle receiving face 72*a*), a shutter closing mechanism 72*d* as a shutter gripping mechanism, and the toner supply inlet 72*w*. The bottle receiving face 72*a* functions as a sliding face of the toner container 32Y during the attachment and detachment operation of the toner container 32Y, and functions as a holder of the container body 33Y that is rotationally driven after the setting of the toner container 32Y is completed. The two stopper release biasing portions 72*b* are trapezoidal ribs formed on the bottle receiving face 72*a* on the side of the cap holder 73 (i.e., on the downstream in the installation direction of the toner container 32Y). As described above with reference to FIGS. 13A, 13B, 13C, 14A, and 14B, the two stopper release biasing portions 72*b* push up the two stopper releasers 34*d*21 of the shutter 34*d* in conjunction with the mounting operation of the toner container 32Y. The two stopper release biasing portions 72*b* release the contact state between the two stoppers 34*d*22 and the two contact portions 34*n*5 (i.e., enable the opening operation of the shutter 34*d*).

The shutter closing mechanism 72*d* (i.e., the shutter gripping mechanism) is disposed upstream in the installation direction (i.e., above the bottle holder 72 covered with the cap holder 73) of the toner container 32Y with respect to the toner supply inlet 72*w*. The shutter closing mechanism 72*d* is a pair of substantially horseshoe-shaped members facing each other so as to sandwich the shutter 34*d*, and is configured to be rotatable around a support shaft on which a torsion coil spring is disposed. Then, the shutter closing mechanism 72*d* sandwiches a sandwiched portion 34*d*11 (see FIGS. 11 and 12) of the shutter 34*d* during the opening and closing operation of the shutter 34*d* in the toner container 32Y. The postures of the shutter 34*d* and the cap 34Y at the cap holder 73 during the opening and closing operation of the shutter 34*d* are determined. As a result, the shutter 34*d* can be smoothly opened and closed.

FIGS. 16A to 16C are diagrams illustrating an operation of the shutter closing mechanism 72*d* (i.e., the shutter gripping mechanism) and an operation of the shutter 34*d* accompanying the opening and closing operation of the shutter 34*d*. The shutter closing mechanism 72*d* is in a state as illustrated in FIG. 16A when the toner container 32Y is not attached. During the opening operation of the shutter 34*d*, as illustrated in FIG. 16B, the shutter 34*d* approaches the shutter closing mechanism 72*d* as the toner container 32Y is attached in the direction indicated by the arrow in FIG. 16B. Referring to FIG. 16C, when the mounting operation of the toner container 32Y proceeds, the shutter closing mechanism 72*d* sandwiches the sandwiched portion 34*d*11 (see FIGS. 11 and 12) of the shutter 34*d*, and rotates around the support shaft. After that, the shutter 34*d* contacts the wall portion formed around the toner supply inlet 72*w* of the cap holder 73. The movement of the shutter 34*d* in the cap holder 73 is restricted. The shutter 34*d* does not move in the longitudinal direction. Since the movement of the toner container 32Y proceeds in the installation direction, the shutter 34*d* moves relatively in the opening direction. In this way, as illustrated in FIG. 16C, the shutter 34*d* moves relatively toward the container body 33Y, and the toner discharge port W is opened. On the other hand, when the toner container 32Y is taken out (removed) from the toner container mount 70 (i.e., the cap holder 73), the operation is performed in the reverse procedure of the above-described mounting procedure.

The configuration and operations of the toner container 32Y according to the present embodiment are described in detail below. As described above with reference to FIGS. 13A to 13C, the toner container 32Y in the present embodiment includes the shutter 34*d* that opens and closes the toner discharge port W. As illustrated in FIGS. 11 and 12, the shutter 34*d* has the shutter main portion 34*d*1 and a plurality of shutter deforming portions 34*d*2. The shutter main portion 34*d*1 engages with the slide groove 34*n*1 (see FIG. 8) as a rail extending in the longitudinal direction (i.e., the direction in which a rotation axis X extends in FIG. 3). The shutter main portion 34*d*1 moves along the slide groove 34*n*1 (i.e., the rail) to open and close the toner discharge port W. The plurality of shutter deforming portions 34*d*2 are integrated with the shutter main portion 34*d*1, and are formed so as to be elastically deformable upward and downward with respect to the connecting positions with the shutter main portion 34*d*1 as the base points. In particular, in the present embodiment, as a plurality of shutter deforming portions, the two shutter deforming portions 34*d*2 are arranged side by side with a gap in a direction substantially orthogonal to the longitudinal direction (i.e., the left-right direction in FIG. 9).

As illustrated in FIGS. 11, 12, 13A, 13B, and 13C, each of the two shutter deforming portions 34*d*2 has the stopper 34*d*22 and the stopper releaser 34*d*21. The stopper 34*d*22 contacts the contact portion 34*n*5 formed in the toner container 32Y to restrict the movement of the shutter in the direction of opening the toner discharge port W from a state where the toner discharge port W is closed. The stopper releaser 34*d*21 receives an external force from below to displace the stopper 34*d*22 with the elastic upward deformation of the shutter deforming portion 34*d*2. The stopper releaser 34*d*21 releases the contact state of the stopper 34*d*22 with the contact portion 34*n*5.

In particular, the plurality of stopper releasers 34*d*21 contact the stopper release biasing portions 72*b* (i.e., the plurality of stopper release biasing portions 72*b* formed so as to correspond to the plurality of stopper releasers 34*d*21 in FIGS. 14A, 14B, and 15) formed so as to protrude upward in the main body of the image forming apparatus 100 as the toner container 32Y is attached to the main body of the image forming apparatus 100 (i.e., the toner container mount 70) as the toner container 32Y is attached to the main body of the image forming apparatus 100. Thus, the stopper 34*d*22 displaces upward. The plurality of stopper releasers 34*d*21 are formed so as to protrude downward in the vertical direction with the toner container 32Y mounted on the main body of the image forming apparatus 100.

The plurality of shutter deforming portions 34*d*2 are configured so that the contact state between the stopper releaser 34*d*21 and the contact portion 34*n*5 is released independently with respect to the other shutter deforming portion 34*d*2. Specifically, a release operation of the contact state between the stopper releaser 34*d*21 in one of the two shutter deforming portions 34*d*2 and one of the contact portions 34*n*5, and a release operation of the contact state between the stopper releaser 34*d*21 in the other of the two shutter deforming portions 34*d*2 and the other of the contact portions 34*n*5, are performed independently. Then, the timing of the release operations is substantially the same. When the contact state of the stopper 34*d*22 with the contact portion 34*n*5 is released in all of the plurality of shutter deforming portions 34*d*2, the restriction of the movement of the shutter 34*d* in the opening direction (i.e., the lower side of FIG. 9) is released. That is, when the contact state between the stopper releaser 34*d*21 of the one shutter deforming portion 34*d*2 out of the two shutter deforming portions 34*d*2 and the contact portion 34*n*5 is released, the restriction on the movement of the shutter 34*d* in the opening direction is not released. When both of the contact states between the stopper releaser 34*d*21 of the two shutter deforming portions 34*d*2 and the contact portion 34*n*5 are released, the restriction on the movement of the shutter 34*d* in the opening direction is released.

In the toner container 32Y of the present embodiment, since the shutter 34*d* is provided with the shutter deforming portion 34*d*2 that elastically deforms at the connecting position with the shutter main portion 34*d*1 as the base point and the shutter deforming portion 34*d*2 has the stopper 34*d*22 that restricts the movement of the shutter 34*d* in the opening direction and the stopper releaser 34*d*21 that release the stopper 34*d*22, the shutter 34*d* does not unexpectedly open the toner discharge port W with the toner container 32Y as a single unit. The shutter 34*d* opens the toner discharge port W in conjunction with the mounting operation only when the toner container 32Y is mounted in the main body of the image forming apparatus 100. In the present embodiment, the shutter 34*d* has a plurality of shutter deforming portions 34*d*2. Even if users accidentally touch one of the stopper releasers 34*d*21 and the contact state between one of the stoppers 34*d*22 and the contact portion 34*n*5 is released in a state where the toner container 32Y is not attached in the main body of the image forming apparatus 100, the contact state between the other stopper 34*d*22 and the contact portion 34*n*5 has not been released. Thus, the movement restriction of the shutter 34*d* is unlikely to be released. Therefore, the shutter 34*d* of the toner container 32Y, which is not mounted on the main body of the image forming apparatus 100, moves so as to open the toner discharge port W, a defect that the toner leaks from the toner discharge port W is unlikely to occur.

In the toner container 32Y of the present embodiment, the above-described toner discharge port W, the slide groove 34*n*1 (i.e., the rail), the shutter 34*d*, and the contact portion 34*n*5 are disposed in the cap 34Y held without rotation in the main body of the image forming apparatus 100. The opening and closing operations of the shutter 34*d* described above is stably performed without rotation.

As illustrated in FIGS. 11 and 12, in the present embodiment, the plurality of shutter deforming portions 34*d*2 are formed so as to be connected to the shutter main portion 34*d*1 without being connected to the other shutter deforming portion 34*d*2. With such a configuration, a release operation of the contact state between the stopper releaser 34*d*21 in one of the two shutter deforming portions 34*d*2 and one of the contact portions 34*n*5, and a release operation of the contact state between the stopper releaser 34*d*21 in the other of the two shutter deforming portions 34*d*2 and the other of the contact portions 34*n*5, are performed independently.

In the present embodiment, the plurality of shutter deforming portions 34*d*2 is formed so as to extend toward upstream (i.e., the lower side of FIG. 9) of the shutter main portion 34*d*1 in the installation direction in which the toner container 32Y is attached to the main body of the image forming apparatus 100. Accordingly, the shutter 34*d* is smoothly opened in conjunction with the mounting operation of the toner container 32Y mounted on the main body of the image forming apparatus 100 with the cap 34Y as the head.

In the present embodiment, the plurality of stoppers 34*d*22 formed on the plurality of shutter deforming portions 34*d*2 is formed so as to extend toward upstream (i.e., the lower side of FIG. 9) of the shutter main portion 34*d*1 in the installation direction in which the toner container 32Y is attached to the main body of the image forming apparatus 100. Accordingly, the shutter 34*d* is smoothly opened in conjunction with the mounting operation of the toner container 32Y mounted on the main body of the image forming apparatus 100 with the cap 34Y as the head.

In the present embodiment, the shutter main portion 34*d*1 and the plurality of shutter deforming portions 34*d*2 are integrally molded with an elastic resin material. Accordingly, the shutter 34*d* is opened and closed by utilizing an elastic deformation as described above.

In the present embodiment, the two stopper releasers 34*d*21 provided on the two shutter deforming portions 34*d*2 are formed so that the positions in the longitudinal direction (i.e., the vertical direction in FIG. 9) substantially coincide with each other. Accordingly, a release operation of the contact state between the stopper releaser 34*d*21 in one of the two shutter deforming portions 34*d*2 and one of the contact portions 34*n*5, and a release operation of the contact state between the stopper releaser 34*d*21 in the other of the two shutter deforming portions 34*d*2 and the other of the contact portions 34*n*5, are performed independently. The timing of the release operations is substantially same. Therefore, the shutter 34*d* is opened and closed smoothly as compared with the case where the release timing is deviated.

As described above, the toner container 32Y in the present embodiment is the toner container 32Y mounted in the longitudinal direction with respect to the main body of the image forming apparatus 100 in a state where the longitudinal direction is to be horizontal. The toner container 32Y has the toner discharge port W and the shutter 34*d* in a state of being mounted on the main body of the image forming apparatus 100. The toner discharge port W discharges vertically downward the toner stored in the toner container 32Y. The shutter 34*d* opens and closes the toner discharge port W. The shutter 34*d* is engaged with the slide groove 34*n*1 (i.e., the rail) extending in the longitudinal and moves along the slide groove 34*n*1. The shutter 34*d* has the shutter main portion 34*d*1 to open and close the toner discharge port W and the plurality of shutter deforming portions 34*d*2 formed integrally on the shutter main portion 34*d*1. Each of the plurality of shutter deforming portions 34*d*2 is deformable in the vertical direction with respect to the connecting position with the shutter main portion 34*d*1 as a base point. Each of the plurality of shutter deforming portions 34*d*2 has the stopper 34*d*22 and the stopper releaser 34*d*21. The stopper 34*d*22 contacts the contact portion 34*n*5 formed in the toner container 32Y to restrict the movement of the shutter 34*d* in the direction of opening the toner discharge port W from the closed state of the toner discharge port W. The stopper releaser 34*d*21 receives an external force from below to displace the stopper 34*d*22 upward to release the contact state with the contact portion 34*n*5 with the elastic upward deformation of the shutter deforming portion 34*d*2. The plurality of shutter deforming portions 34*d*2 are configured so that the contact state between the stopper releaser 34*d*21 of one of the shutter deforming portions 34*d*2 and the contact portion 34*n*5 is released independently of the contact state between the stopper releaser 34*d*21 of the other of the shutter deforming portions 34*d*2 and the contact portion 34*n*5. When the contact state is released in all of the plurality of shutter deforming portions 34*d*2, the restriction of the movement of the shutter 34*d* in the opening direction is released. Accordingly, a problem that the movement restriction of the shutter 34*d* by the stopper 34*d*22 is released when the main body of the image forming apparatus 100 is not attached is unlikely to occur.

In the present embodiment, although only toner is stored in the toner containers 32Y, 32M, 32C, and 32K, toner containers may contain a two-component developer including toner and carrier to be used in image forming apparatuses in which the two-component developer is appropriately supplied to the developing device. In such configurations, similar effects to the above-described embodiments are also attained.

In the present embodiment, at least one of the image forming units 6Y, 6M, 6C, and 6K may be used as a process cartridge. In such configurations, similar effects to the above-described embodiments are also attained.

In the present embodiment, the container body 33Y is configured to be rotatable so that the toner contained in the container body 33Y is conveyed toward the opening portion A. On the other hand, the container body 33Y may be held by the toner container mount 70 together with the cap 34Y without rotation. The container body 33Y may include a conveyor (e.g., a conveyor that a conveying coil and a plurality of conveying blades are disposed in a shaft shape and is rotated in a predetermined direction by a gear independent of the container body) that conveys the toner stored inside the container body 33Y toward the opening portion A.

In the present embodiment, although the shutter 34*d* has two shutter deforming portions 34*d*2, the shutter 34*d* may be provided with three or more shutter deforming portions 34*d*2. In such configurations, similar effects to the above-described embodiments are also attained.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Further, the number, position, shape, and so on of components are not limited to those of the present embodiment, and may be the number, position, shape, and so on that are suitable for implementing the present disclosure. Such variations are not to be regarded as a departure from the scope of the present disclosure and appended claims, and all such modifications are intended to be included within the scope of the present disclosure and appended claims.

The invention claimed is:

1. A toner container configured to be attached to a main body of an image forming apparatus in a longitudinal direction of the toner container with the longitudinal direction being horizontal, the toner container comprising:

a toner discharge port to discharge toner contained in the toner container vertically downward in a state in which the toner container is attached in the main body of the image forming apparatus; and a shutter to open and close the toner discharge port, the shutter including:

a shutter main portion to engage with a rail extending in the longitudinal direction and move along the rail to open and close the toner discharge port;

a plurality of shutter deforming portions integrated with the shutter main portion and which are deformable upward and downward with respect to a connecting position with the shutter main portion as a base point, each of the plurality of shutter deforming portions being elongated and extending in the longitudinal direction, each of the plurality of shutter deforming portions including:

a corresponding stopper to contact a contact portion of the toner container to restrict a movement of the shutter in an opening direction in which the shutter opens the toner discharge port from a state in which the toner discharge port is closed by the shutter, the stopper being at a tip end of the corresponding shutter deforming portion; and a corresponding stopper releaser to receive an external force from below to displace the corresponding stopper upward with elastically upward deformation of each of the plurality of shutter deforming portions to release a contact state of the stopper with the contact portion, the stopper releaser being disposed away from the tip end of the corresponding shutter deforming portion towards the shutter main portion, and wherein the stopper releaser of one of the plurality of shutter deforming portions is configured to release the contact state with the contact portion independently of another of the plurality of shutter deforming portions, and wherein when the contact state of the stopper with the contact portion is released in all of the plurality of shutter deforming portions, restriction of the movement of the shutter in the opening direction is released.

2. The toner container according to claim 1 further comprising:

a container body to store toner; and a cap to communicate with the container body, and wherein the cap has the toner discharge port, the rail, the shutter, and the contact portion.

3. The toner container according to claim 1, wherein the stopper releaser of each of the plurality of shutter deforming portions is protrudes vertically downward in the state in which the toner container is attached in the main body of the image forming apparatus.

4. The toner container according to claim 1, wherein the stopper releaser of each of the plurality of shutter deforming portions is to contact a stopper release biasing portion protruding upward in the main body of the image forming apparatus as the toner container is attached to the main body of the image forming apparatus, to displace the stopper upward.

5. The toner container according to claim 1, wherein the plurality of shutter deforming portions connect to the shutter main portion without connecting to each other.

6. The toner container according to claim 1, wherein the plurality of shutter deforming portions extend upstream of the shutter main portion in the longitudinal direction in which the toner container is attached to the main body of the image forming apparatus.

7. The toner container according to claim 1, wherein the stopper of each of the plurality of shutter deforming portions is disposed upstream of the shutter main portion in the longitudinal direction in which the toner container is attached to the main body of the image forming apparatus.

8. The toner container according to claim 1, wherein the shutter main portion and the plurality of shutter deforming portions are molded with an elastic resin material as an integrated unit.

9. The toner container according to claim 1, wherein the plurality of shutter deforming portions are two shutter deforming portions arranged side by side with a gap in a direction substantially orthogonal to the longitudinal direction, and wherein two stopper releasers of the two shutter deforming portions are disposed at substantially same positions in the longitudinal direction.

10. The toner container according to claim 1, wherein the toner is stored in the toner container.

11. An image forming apparatus comprising the toner container according to claim 1, wherein the toner container is attached in the main body of the image forming apparatus.

12. The image forming apparatus according to claim 11, further comprising a plurality of stopper release biasing portions corresponding to a plurality of stopper releasers of the plurality of shutter deforming portions.

13. The toner container according to claim 1, wherein:

each of the stopper releasers is disposed away from the tip end of the corresponding shutter deforming portion by an amount greater than a length of each of the shutter deforming portions.

* * * * *